United States Patent [19]

Pryor

[11] Patent Number: 4,770,193

[45] Date of Patent: Sep. 13, 1988

[54] MANUFACTURE OF TOBACCO SMOKE FILTERS

[75] Inventor: James W. Pryor, Winston-Salem, N.C.

[73] Assignee: R. J. Reynolds Tobacco Company, Winston-Salem, N.C.

[21] Appl. No.: 15,251

[22] Filed: Feb. 17, 1987

Related U.S. Application Data

[62] Division of Ser. No. 759,894, Jul. 29, 1985, which is a division of Ser. No. 500,418, Jun. 2, 1983, Pat. No. 4,549,875.

[51] Int. Cl.[4] ..... A24D 3/02; A24D 3/04

[52] U.S. Cl. ..... 131/344; 131/335; 131/341; 131/342; 131/343; 131/346; 493/46; 493/47; 493/49

[58] Field of Search ..... 131/334, 340, 341, 342, 131/343, 344, 346; 493/46, 47, 49

[56] References Cited

U.S. PATENT DOCUMENTS

| | | | |
|---|---|---|---|
| 3,288,150 | 11/1966 | Burke et al. | 131/334 |
| 3,396,061 | 8/1968 | Browne . | |
| 4,281,671 | 8/1981 | Byrne et al. . | |
| 4,291,711 | 9/1981 | Berger . | |

*Primary Examiner*—V. Millin

*Attorney, Agent, or Firm*—Herbert J. Bluhm

[57] ABSTRACT

A smoke filter and a method for manufacturing the filter from a continuous multifilament filter tow are described in which a portion of the filter tow is treated with a dye to impart color to a discrete elongated zone of dye-treated filaments that is in substantial alignment with the longitudinal axis of the smoke filter.

23 Claims, 6 Drawing Sheets

MANUFACTURE OF TOBACCO SMOKE FILTERS

This is a divisional of co-pending application Ser. No. 759,894 filed on July 29, 1985 which, in turn, is a divisional of co-pending application Ser. No. 500,418 filed on June 2, 1983, now U.S. Pat. No. 4,549,875.

TECHNICAL FIELD

This invention relates to the processing of a continuous, multifilament filter tow for the manufacture of tobacco smoke filters.

BACKGROUND ART

The manufacture of tobacco smoke filters from a continuous multifilament filter tow generally involves processing steps which include separation of the individual filaments (i.e., "opening up" of the filter tow), the application of plasticizer and other additives to the "opened up" tow and the formation of a continuous filter rod from the treated filter tow. The uniformity and filtering characteristics of the resulting filter rod are largely determined by the effectiveness of these tow processing steps. The processing steps become particularly critical when the applied additives include flavoring materials or other active agents which modify the tobacco smoke as it passes through the filter.

U.S. Pat. No. 2,966,198 discloses apparatus for applying aqueous solutions of cellulose derivatives to filter tow as the tow is subjected to a turbulent current of air. Although this apparatus may be suitable for applying solutions of film-forming binders to the tow, it does not provide the degree of control required for producing a uniform filter rod.

The application of various flavoring materials to tobacco smoke filters is disclosed in U.S. Pat. No. 3,144,024 but apparatus for incorporating such materials is not specifically described.

U.S. Pat. Nos. 3,371,000 and 3,847,064 disclose methods and apparatus for making tobacco smoke filters containing added filtration materials such as activated carbon. Various apparatus designs are described which inject a slurry of activated carbon into the filter tow at spaced intervals. Closely related to these patents are U.S. Pat. Nos. 3,095,343 and 3,774,508 which describe methods and apparatus for shaping filter tow into a hollow cylindrical rod by positioning a mandrel concentrically in the path of the moving filter tow and injecting steam into the filter tow.

In U.S. Pat. Nos. 3,779,787 and 3,853,039 an additive is introduced into a filter rod by piercing the rod with a needle and submerging the pierced rod in a liquid additive bath or, alternatively, by directing a jet of liquid additive against the rod with sufficient force to impregnate the filter rod.

Another method for incorporating additives into tobacco smoke filters is disclosed in U.S. Pat. No. 4,281,671 and involves combining filter tow and a thread impregnated with a smoke-modifying agent in the manufacture of a tobacco smoke filter. The surface area presented by the impregnated thread is quite limited, however, and the portion of tobacco smoke contacting the thread is also correspondingly quite limited.

A dual filter construction is disclosed in U.S. Pat. No. 3,313,306 which is formed from a fibrous filter tow that may optionally be treated with additives. The filter tow is formed into an elongated rod which is compressed at spaced locations to give a compacted core of tow that is provided with an annular sheath of a second filter material such as carbon granules at the spaced locations.

U.S. Pat. No. 4,291,711 discloses a filter formed from reconstituted tobacco and a fibrous filter tow with either material constituting a central longitudinal core that is enveloped by an annular sheath of the other material. The reconstituted tobacco may optionally be treated with tobacco flavorants.

The manufacture of filter rods from continuous multifilament filter tow typically involves moving the filter tow in a generally longitudinal direction through a succession of treatment steps designed to align and spread apart the individual filaments by mechanical and/or pneumatic means so that plasticizers and other additives may be applied to the aligned and spread filter tow before the tow is gathered and formed into a predetermined shape such as a substantially cylindrical rod. The processing steps may also include the application of paper wrap to the filter tow to produce a paper wrapped filter rod. When the manufacture of filter rods also involves incorporation of flavoring materials, the application of flavoring materials to the filter tow has heretofore generally involved dissolving such materials in the plasticizer. Such a method of application, however, does not provide a very precise degree of control over the levels of flavoring materials applied to the filter tow and it also results in contamination of the apparatus used for applying plasticizer. The contamination problem is particularly objectionable when filter rods containing different flavoring materials are to be produced using the same apparatus.

Current commercial manufacture of filter rods from filter tow involves two basic techniques for pretreatment of the tow prior to formation of the filter rod. One technique uses pneumatic banding jets and cooperating sets of rolls including circumferentially grooved rolls adapted to contact and to spread and stretch the filter tow thereby transforming the tow into a flat wide band that is then passed through a chamber where plasticizer is applied to the band of tow by spray or other suitable means. The other technique employs a pneumatic banding jet to create a narrow flat band of tow that is drawn across wick-type applicators which deposit plasticizer on both sides of the band of tow before the tow is passed through a jet device for stretching, aligning and blooming the tow. In both techniques the pretreated filter tow, comprising a longitudinally oriented assemblage of filaments having individual filaments of the tow in substantial alignment, is fed into a converging horn or funnel located adjacent to the entrance of filter rod-forming means. The converging horn or funnel gathers and compresses the filter tow into a rounded, rope-like configuration and a tongue device located between the converging funnel and rod-forming means applies further converging and compressing forces to the filter tow as the tow enters the garniture of the rod-forming means. The rod-forming means may be provided with means for heating the advancing filter tow sufficiently to produce a stable, continuous non-wrapped filter rod or it may be provided with means for wrapping the filter tow in a continuous paper web to produce a continuous paper-wrapped filter rod. In some commercial filter rod-forming operations, a stuffer jet or transport jet is utilized as converging means for gathering the flat band of treated filter tow and transforming it into a loosely compacted rope-like configuration that is directed to the rod-forming means. The stuffer jet or transport jet is usually located adjacent the entrance to the rod-forming means. Stuffer jets or transport jets typically comprise a truncated cone-shaped device having a large end for receiving the advancing filter tow and a small end for discharging the filter tow with orifice means intermediate the large end and small end for directing a pressurized gaseous medium onto the advancing filter tow.

BRIEF SUMMARY OF THE INVENTION

This invention provides an improved method and apparatus for applying a smoke-modifying agent to a continuous multifilament filter tow in conjunction with the manufacture of tobacco smoke filters from the tow.

It is a principal object of this invention to provide a method and apparatus for applying a smoke-modifying agent to a continuous multifilament filter tow subsequent to flexing and tensioning of the tow but prior to formation of the tow into a filter rod of predetermined shape.

It is a further object of this invention to provide a method and apparatus for applying uniform amounts of a smoke-modifying agent to selected portions of a filter rod formed from a continuous multifilament filter tow.

An additional object of this invention is to provide a method and apparatus for applying flavoring materials to a continuous multifilament filter tow in connection with the formation of a filter rod that is subsequently cut into individual filters for cigarettes.

Yet a further object of this invention is to provide a tobacco smoke filter having a zone of flavoring materials selectively located to facilitate transfer of the flavoring materials to tobacco smoke passing through the filter.

Other objects and advantages will be apparent from the detailed description which follows.

DETAILED DESCRIPTION OF THE INVENTION

Figure 1:
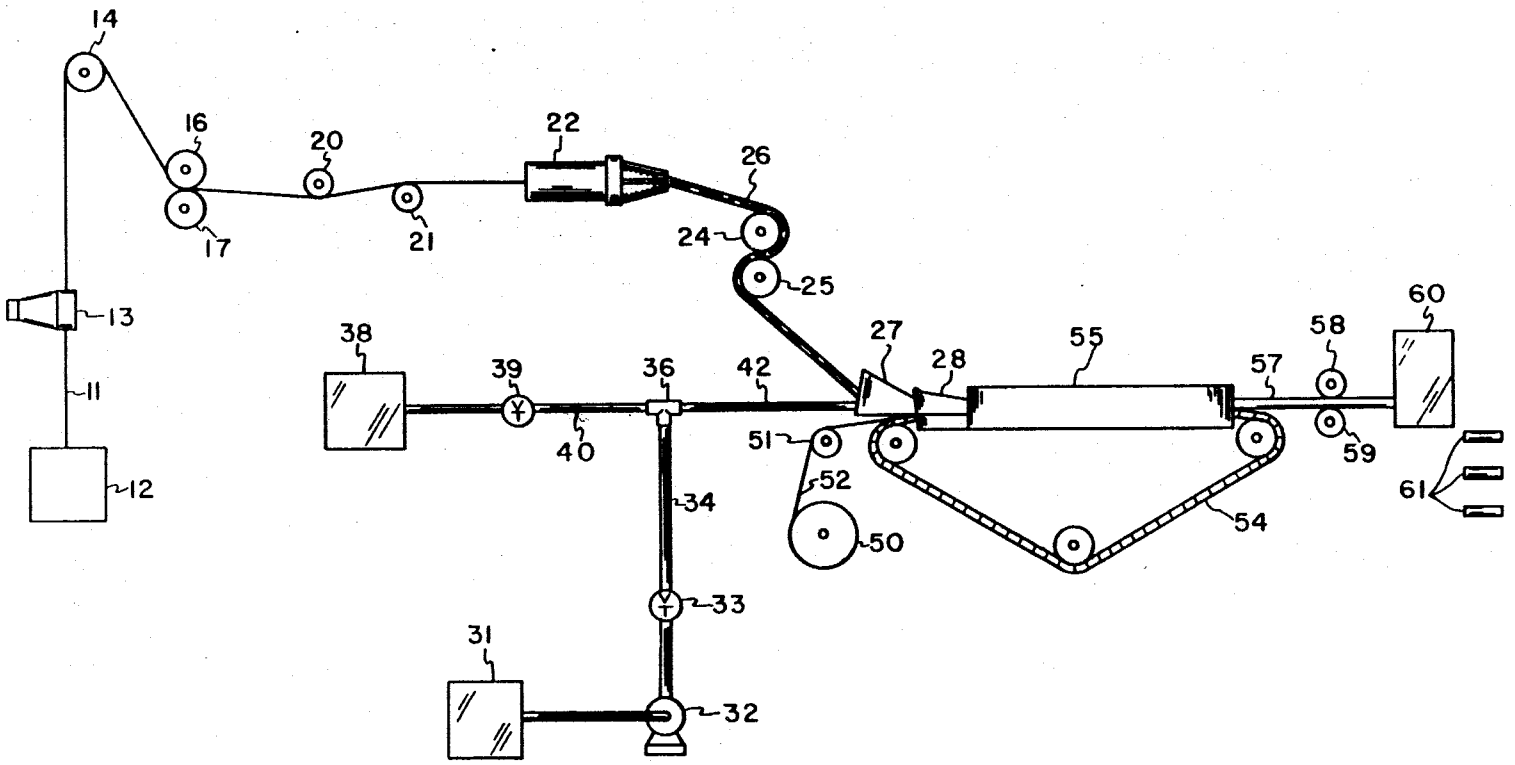
FIG. 1 is a schematic representation of apparatus for processing filter tow in accordance with the present invention.

This invention provides a convenient and effective apparatus and method for applying a smoke-modifying agent to a continuous multifilament filter tow as the tow is being formed into a continuous filter rod that is subsequently cut into segments and used for filtering tobacco smoke. The invention is particularly suitable for the application of flavoring materials to the filter tow although other materials such as plasticizers and smoke filtration agents may also be applied. The term "smoke-modifying agent" as used herein is not considered to include filter tow plasticizing agents such as triacetin but does include flavoring materials and agents capable of selectively removing certain tobacco smoke components from the smoke as it passes through the filter. The manner in which the additive is applied also lends itself to controlling the location of the applied additive in the formed filter rod since processing arrangements can be selected for applying the additive under relatively non-turbulent conditions.

The smoke-modifying agents used in connection with the present invention are preferably compounds or mixtures of compounds which exist in the liquid or vapor state at the temperature and pressure conditions prevailing during application of the agents to the tow. The agents may also take the form of solutions, emulsions or suspensions of solid or liquid or microencapsulated organic flavoring compounds in water, triacetin, ethanol, propylene glycol or other suitable liquid carrier media. A further variation involves the application of a volatile additive in vapor form to the filter tow under conditions that would permit condensation of the additive on the tow, absorption of the additive vapors by plasticizer previously applied to the tow or adsorption of the additive vapors by the filter tow or other agents associated with the tow. Regardless of the manner in which the smoke-modifying agents are applied to the filter tow, the quantity of agent injected into the tow, including any liquid carrier media used, will normally not exceed 15 percent by weight based on the total weight of the filter tow being processed and, preferably, will not exceed 10 percent. Solutions of flavoring materials are typically applied at levels of 5 percent by weight or less based on the weight of tow being processed.

The apparatus used in accordance with this invention for manufacturing a filter rod containing a smoke-modifying agent comprises a) means for moving a continuous multifilament filter tow through a succession of treatment steps with the direction of movement coinciding generally with the longitudinal axis of the filter tow, b) means for transforming the moving filter tow into a longitudinally oriented assemblage of filaments having individual filaments of the tow in substantial alignment, c) converging means for gathering and compressing the longitudinally oriented assemblage of filaments to produce a longitudinally oriented filter tow with a rope-like configuration, d) nozzle means associated with said converging means and positioned in the path of the moving filter tow so that the nozzle means is substantially enveloped by the moving filter tow in encircling fashion, e) means for supplying controlled amounts of a smoke-modifying agent to the nozzle means for application of the agent to the moving filter tow and f) rod-forming means adjacent to the converging means adapted to receive the longitudinally oriented, rope-like filter tow treated with the smoke-modifying agent and to form the filter tow into a filter rod having a predetermined shape.

The basic arrangement described herein for processing the filter tow is conventional and this provides one of the principal advantages of the present invention. The modifications to the tow processing apparatus required for incorporating the improvements of this invention are not disruptive and do not interfere to any significant degree with operation of the apparatus in the conventional manner, if desired. This invention, therefore, provides great flexibility in operation because the mode of operation can be changed almost instantaneously.

The principal feature of this invention involves the positioning of nozzle means in the path of a moving filter tow downstream of a point at which the filter tow has been sufficiently gathered and compressed by converging means to envelop the nozzle means in substantially encircling fashion. Since the advancing filter tow substantially envelops the nozzle means in encircling fashion, it is apparent that the physical size of the nozzle means or spraying device must be limited in order to minimize interference with movement of the filter tow. It is also important that the advancing filter tow be gathered and at least partially compressed at the point where it envelops the nozzle means in encircling fashion. Accordingly, the modified apparatus of this invention generally includes conduit means associated with the nozzle means and the longitudinal axis of a major portion of the combined conduit and nozzle means that is positioned in the path of the filter tow is in substantial longitudinal alignment with the longitudinal axis of the encircling filter tow. It is preferred that the cross-sectional area (i.e., a section transverse to the longitudinal axis) of the nozzle means as well as any portion of the associated conduit means enveloped by the filter tow not exceed about 25 percent of the transverse cross-sectional area of the filter tow-confining passageway which surrounds the nozzle means and associated conduit means. If the nozzle means comprises two or more spraying devices and conduit means associated therewith, the cross-sectional area of each will be correspondingly reduced so that the combined transverse cross-sectional area of the spraying devices and associated conduit means enveloped by the encircling tow will not exceed about 25 percent of the transverse cross-sectional area of the filter tow-confining passageway which surrounds the spraying devices and associated conduit means.

The nozzle means and associated conduit means may be fabricated from any suitable material; however, metallic or plastic materials which are relatively rigid are preferred so that the nozzle means will remain in an essentially fixed position in the path of the filter tow. The conduit means with the nozzle means attached to the terminus thereof may, for example, extend into or through the converging horn a sufficient distance to position the nozzle means directly in the path of the filter tow as it moves toward the rod-forming means. The nozzle means and associated conduit means may also be positioned in the filter tow path within the tongue device adjoining the inlet zone of the rod-forming means or they may extend slightly beyond the termination point of the tongue device in the inlet zone of the rod-forming means. Alternatively, the nozzle means may be positioned within a stuffer jet or transport jet in the event such devices are used in processing the tow. When such jet devices are used, it is preferred that the nozzle means be positioned downstream of the orifice means employed in those devices. In all cases the nozzle means and associated conduit means should be in substantial longitudinal alignment with the longitudinal axis of the advancing filter tow and be securely anchored to a suitable fixed support to avoid excessive lateral movement of the nozzle means as the encircling filter tow moves past it.

Various nozzle designs and arrangements may be used with this invention depending on the particular results desired. In those cases where a liquid additive, solution or suspension is being applied, it is preferred that the nozzle means be provided with a source of compressed gas that can be injected with the additive to effect atomization of the additive and to improve penetration of the additive into the filter tow filaments immediately surrounding the nozzle means. Distribution of the additive in the filter tow is also increased by employing nozzle means capable of generating a radial spray pattern that is substantially perpendicular to the longitudinal axis of the filter tow.

It is apparent that the portion of the filter tow bundle treated with the smoke-modifying agents will determine the degree to which the smoke-modifying effect is perceived by the smoker. Accordingly, it is important that at least one percent of the filter tow bundle be treated with the additive to provide a significant effect on the smoke. Although the presently disclosed method of applying additive to filter tow is capable of achieving additive penetration throughout the filter tow bundle, total penetration of the filter tow bundle requires injection of the additive with a compressed gas under elevated pressures. As the pressure of the injected gas is increased, dissipation of the injected gas tends to interfere with the orderly movement and compaction of the filter tow as it enters the rod-forming garniture. Thus, the use of gas pressures in excess of 2500 grams per square centimeter in connection with the injection of additives should preferably be avoided. By limiting the gas pressures used for injecting the additives to 2500 $g/cm^2$, the maximum penetration of additive into the filter tow leads to approximately 75 percent of the filter tow bundle being treated. Since the additive distribution pattern achieved by this invention is generally cylindrical in shape with its longitudinal axis substantially parallel to the longitudinal axis of the formed filter rod, the additive-treated portion of the formed filter rod can also be expressed as a function of its cross-sectional area. Consequently, a cross-section that is perpendicular to the longitudinal axis of the formed filter rod may have between 1 and 75 percent of its total area treated with additive depending on the treatment conditions used. Preferably, the discrete zone of filaments which have been treated with the smoke-modifying agent should constitute between 3 and 50 percent of the maximum cross-sectional area of the formed filter rod. It will be apparent to those skilled in the art that the cross-sectional shape of the discrete zone of treated filaments may be circular, elliptical, rectangular, etc. depending on the nozzle design used, the positioning thereof and the operating conditions used in manufacturing the filter rod.

For a better understanding of this invention reference will now be made to the accompanying drawings.

Figure 3:
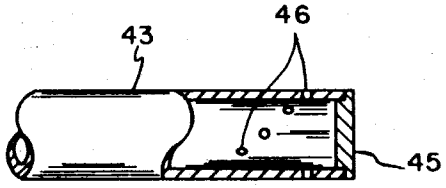
FIG. 3 presents an enlarged view of the nozzle means depicted in FIG. 2 with a portion cut away to show further details.
Figure 2:
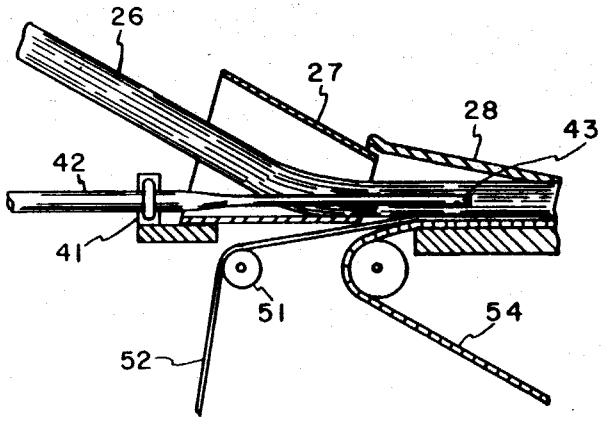
FIG. 2 is an enlarged cross-section of a portion of the apparatus shown in FIG. 1 showing additional details.

One embodiment of the present invention is shown in FIGS. 1, 2 and 3. Filter tow is processed in a conventional manner by withdrawing a continuous multifilament filter tow 11 from tow supply container 12 by feed rolls 16 and 17. The filter tow passes through pneumatic banding jet 13 and over guide roll 14 before reaching feed rolls 16 and 17. Each side of the flattened band of filter tow is then contacted with wick-type applicators 20 and 21 where plasticizer is applied to the tow. The plasticized filter tow then proceeds through jet device 22 which loosens and blooms the filter tow by subjecting it to tension created by a rapidly moving stream of gas thereby producing a longitudinally oriented assemblage of filaments having individual filaments of the tow in substantial alignment. The bloomed filter tow 26 is withdrawn from the jet device by delivery rolls 24 and 25 and is directed to converging horn 27 located adjacent to tongue device 28 associated with rod-forming means 55. A continuous paper web 52 from paper supply roll 50 passes over guide roll 51 and into rod-forming means 55. Converging horn 27 gathers and compresses the longitudinally oriented assemblage of filaments transversely to the direction of filter tow movement and tongue device 28 applies further converging and compressing action to the tow to produce a longitudinally oriented, compacted filter tow that can be enveloped by the paper web as the tow enters the rod-forming means. The longitudinally oriented and compacted filter tow, enveloped by the paper web, is temporarily confined in rod-forming means 55 by endless belt 54 which assumes a substantially cylindrical configuration as it passes through rod-forming means 55. The stable, continuous paperwrapped filter rod 57 is withdrawn from rod-forming means 55 by transport rolls 58 and 59 and is subsequently cut into sections 61 of desired length by cutting means 60.

Figure 7:
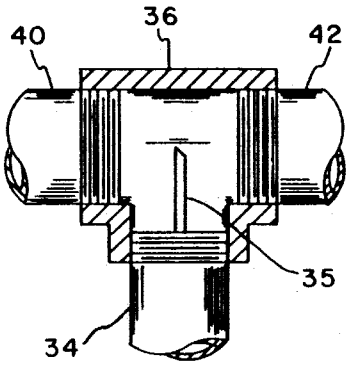
FIG. 7 is an enlarged view of a portion of the additive injection means employed in the embodiments illustrated in each of FIGS. 1, 4 and 6 with a portion cut away to show additional details.

In addition to liquid plasticizer applied to the flattened band of filter tow by applicators 20 and 21, a liquid or vaporous additive is also applied to the filter tow as it moves through converging means just upstream of rod-forming means 55. This additive is injected into the interior portion of the gathered and compressed filter tow by conduit means 42 and nozzle means 43 (see FIGS. 2 and 3) concentrically positioned within the converging means so that the conduit means are in substantial longitudinal alignment with and enveloped in encircling fashion by the moving, gathered and compressed filter tow. Conduit means 42 is secured by support means 41. Preferably, conduit means 42 terminates in nozzle means 43 (FIG. 2) which is designed to direct a radial spray pattern that is substantially perpendicular to the longitudinal axis of the moving filter tow. As shown in FIG. 3, nozzle means 43 may be conveniently fabricated from conduit means 42 by sealing off the terminus thereof with plug 45 and introducing a plurality of holes 46 circumferentially arranged around the periphery of conduit means 42 adjacent plug 45. Additive from additive supply tank 31 is fed by pump 32 through throttle valve 33 and conduit 34 into conduit means 42 and nozzle means 43. The injection of liquid additive by nozzle means 43 is preferably accompanied by the injection of gaseous fluid to effect atomization of the liquid additive as it is injected into the filter tow. Thus, pressurized gas supply 38, throttle valve 39 and conduit 40 provide means for introducing a gaseous fluid into the liquid additive stream flowing through conduit 42. When a gaseous fluid is used to effect atomization, liquid additive is preferably introduced into the gaseous fluid stream by capillary tubing 35 (see FIG. 7) positioned within T-joint 36. The use of capillary tubing 35 allows greater control over low flow rates of additive materials.

Figure 5:
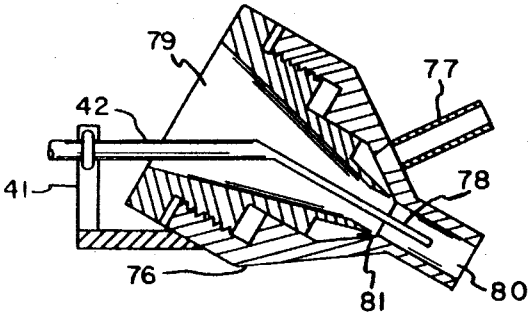
FIG. 5 is an enlarged cross-section of a portion of the apparatus shown in FIG. 4 showing additional details.
Figure 4:
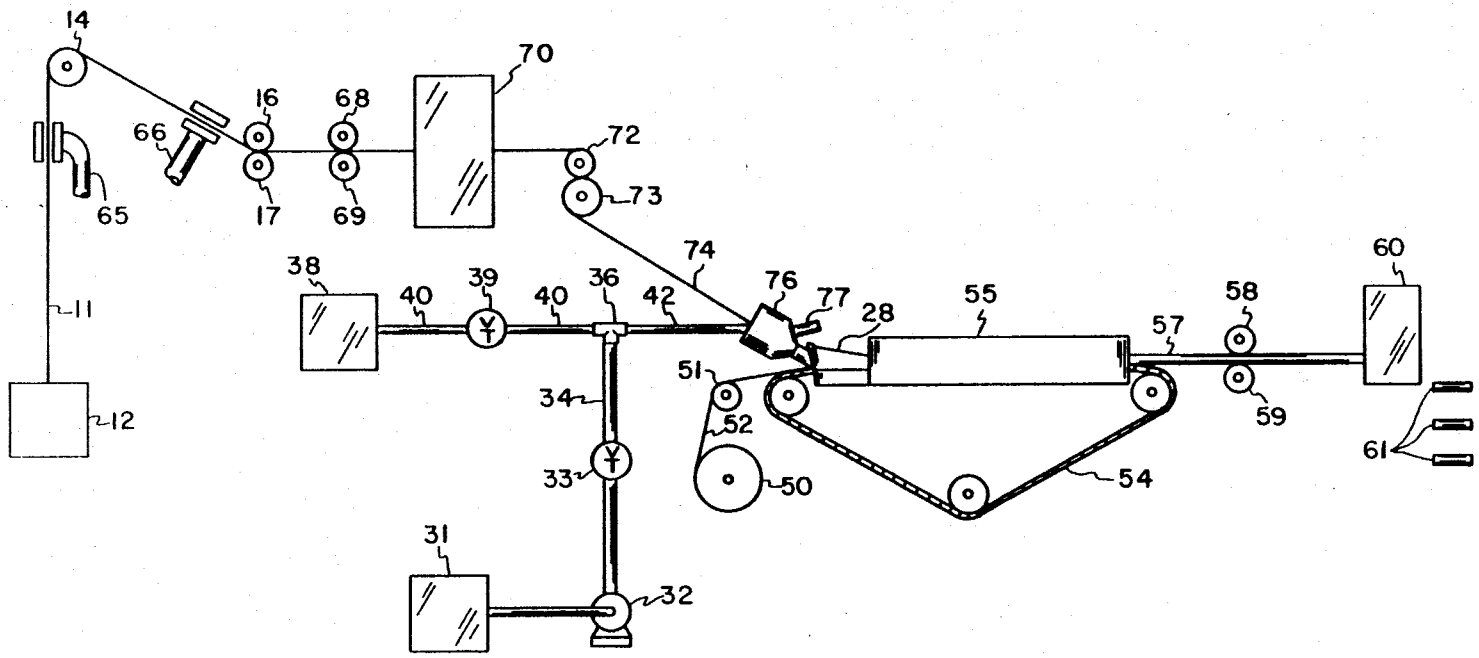
FIG. 4 is a schematic representation of an alternative apparatus for processing filter tow in accordance with the present invention.

Shown in FIG. 4 is another embodiment of the present invention which employs an alternative tow-processing arrangement. Those elements which are common to both FIG. 1 and FIG. 4 processing arrangements are given the same identifying numbers. In the FIG. 4 arrangement filter tow 11 passes through pneumatic banding devices 65 and 66 of known design which devices cause the tow to assume a flat band configuration. The flat band of filter tow is further widened and stretched longitudinally by spreading rolls 68 and 69 which rotate at speeds in excess of the rotational speed of feed rolls 16 and 17. The flat, widened band of filter tow then passes through spray chamber 70 where plasticizer is applied to the filter tow. The plasticizer-treated filter tow 74 is then fed into stuffer jet device 76 by delivery rolls 72 and 73. Each set of rolls 68 and 69 as well as 16 and 17 preferably comprises one roll provided with circumferential grooves and one roll provided with a smooth surface of resilient or elastic material in order to promote more effective spreading, tensioning and transporting action. Circumferentially grooved rolls suitable for processing filter tow are described in U.S. Pat. No. 3,852,007 and may be adapted for use in connection with the present invention. The basic design of stuffer jet device 76 is disclosed in U.S. Pat. No. 3,050,430 and comprises a truncated cone-shaped device having a large end 79 (see FIG. 5) for receiving the filter tow, a small end 80 for discharging the filter tow and orifice means 81 intermediate the large end and small end through which a pressurized gaseous medium is introduced for moving the filter tow through the stuffer jet device. The pressurized gaseous medium is introduced into the jet device through tubular inlet 77. Concentrically positioned within the stuffer jet device 76 downstream of orifice means 81 is nozzle means 78. Nozzle means 78 comprises a length of capillary tubing attached to conduit means 42 which is held in a fixed position by support means 41. Additive from supply tank 31 is introduced into conduit 42 in a manner similar to that described for the FIG. 1 apparatus. Stuffer jet device 76 acts as converging means for gathering and compressing the flat band of plasticizertreated filter tow introduced into the large end 79 of the jet device. As the filter tow enters the small end 80 of the jet device it is subjected to a pressurized gaseous medium issuing from orifice 81 which promotes forward movement of the tow as the tow assumes a rope-like configuration. Simultaneously, additive emerging from nozzle means 78 is applied to the interior portion of the filter tow bundle. The additive may be injected with atomizing gas from pressurized gas supply 38 or, alternatively, the additive may be injected without gas atomization by operating the apparatus with throttle valve 39 in the closed position. The treated tow is then further compressed by tongue device 28 in connection with enveloping the filter tow in a paper wrap and forming it into a stable, continuous paper-wrapped filter rod. When this tow processing arrangement is used, tongue device 28 is preferably provided with a plurality of small holes as shown in U.S. Pat. No. 3,050,430 to permit air directed into the tongue section by the stuffer jet to escape.

Figure 6:
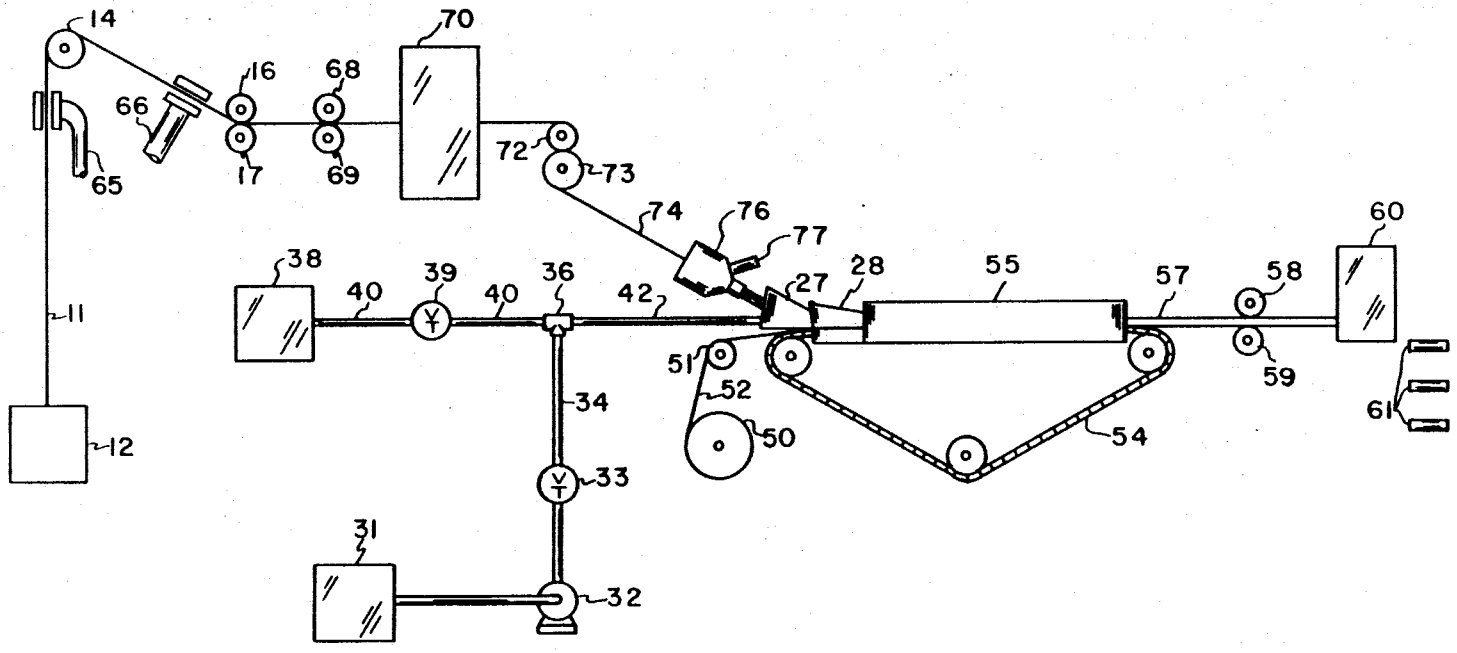
FIG. 6 is a schematic representation of yet another embodiment of apparatus for processing filter tow in accordance with the present invention.

The filter tow processing arrangement shown in FIG. 6 is similar to that depicted in FIG. 4 except that the nozzle means through which the additive is introduced is positioned within tongue device 28 as shown in FIG. 2 instead of within the stuffer jet device 76. Also, the stuffer jet device 76 as well as converging horn 27 are used to apply the gathering and compressing force to the advancing filter tow.

Figure 10B:
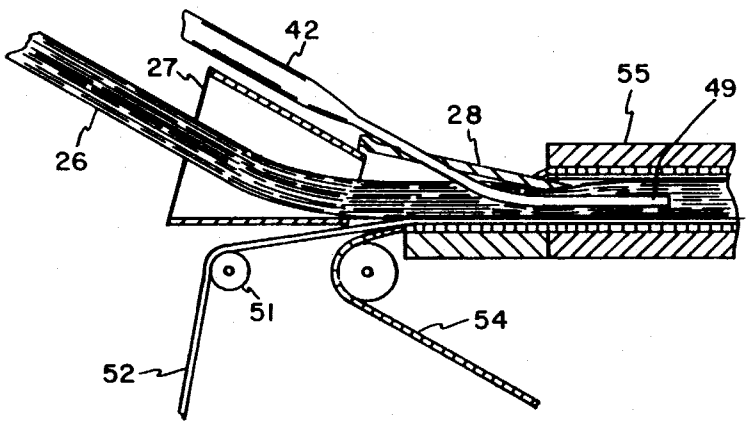
FIGS. 10*a* and 10*b* are enlarged cross-sections similar to that shown in FIG. 2 but illustrating further embodiments of the present invention.
Figure 10A:
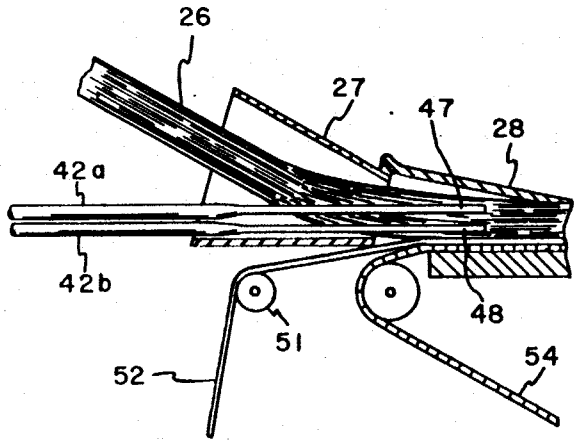

Alternative nozzle arrangements are shown in FIGS. 10*a* and 10*b* for use in the tow processing apparatus depicted in FIGS. 1 and 6. FIG. 10*a* shows conduit means 42*a* and 42*b* terminating, respectively, in nozzle means 47 and 48. Nozzle means 47 and 48 comprise lengths of capillary tubing extending longitudinally into the path of the filter tow and terminating at points below tongue device 28. Each of conduit means 42*a* and 42*b* may be supplied with a smoke-modifying agent from a single supply source to produce a filter rod having two zones of similarly treated filter tow. If desired, two separate supply sources may be used to supply different smoke-modifying agents to each of conduit means 42*a* and 42*b* to produce a filter rod having two different smoke-modifying agents applied to portions of the filter tow.

In the arrangement shown in FIG. 10*b*, tongue device 28 is provided with an opening through which conduit means 42 is introduced. Conduit means 42 extends into the inlet zone of rod-forming means 55 where it terminates in nozzle means 49. The portion of conduit means 42 which extends into the inlet zone of rod-forming means 55 is in substantial longitudinal alignment with the advancing filter tow 26. Hydraulic injection of the smoke-modifying agent by nozzle means 49 in the FIG. 10*b* arrangement is desirable. If the injection is carried out with gas atomization, the use of excessive gas pressures should be avoided so that the compacted filter tow is not disrupted by gas escaping from the confined tow in the garniture of the rod-forming means.

Figure 8:
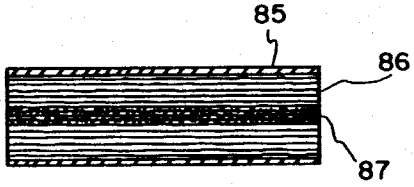
FIG. 8 is a longitudinal cross-section of a typical smoke filter produced in accordance with this invention.
Figure 9B:
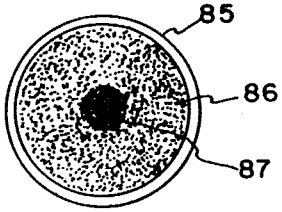
FIGS. 9*a*, 9*b* and 9*c* are end views of smoke filters produced in accordance with this invention.
Figure 9C:
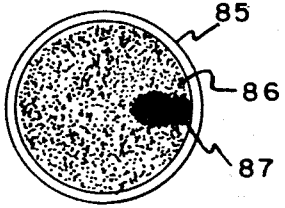
Figure 9A:
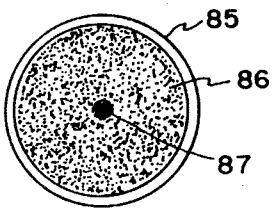

Shown in FIG. 8 is a longitudinal cross section of a typical fibrous filter produced by the apparatus and method disclosed herein. A discrete zone 87 of plasticized filaments treated with a smoke-modifying agent is circumferentially surrounded by a generally annular sheath 86 of plasticized filaments which have not been treated with the smoke-modifying agent. The entire bundle of filaments is enveloped by paper wrap 85. The end views of the filter shown in FIGS. 9*a* and 9*b* provide a good approximation of the radial distribution pattern that is obtained when additive is applied to the moving filter tow. The more limited distribution of additive in FIG. 9*a* results from a spray pattern that is directed primarily in the direction of the longitudinal axis of the filter tow whereas the distribution pattern shown in FIG. 9*b* results from a spray pattern that is substantially perpendicular to the longitudinal axis of the filter tow. Although the discrete zone 87 of treated filaments is shown in FIGS. 8, 9*a* and 9*b* as coinciding generally with the longitudinal axis of the filter rod, it is possible to position this zone adjacent to the outer periphery of the filter rod and paper wrap 85 as shown in FIG. 9*c* by positioning the nozzle means near the periphery of the filter tow bundle It is apparent that the presently disclosed invention is ideally suited to the introduction of flavoring materials into a filter rod because such materials are usually applied at very low levels. Pumps such as geared positive displacement pumps are capable of supplying precise, controlled amounts of additive materials at very low flow rates. Actual flow rates may be measured by commercially available devices such as flow meters based on mass flow or turbine flow principles. Continuous filter rods formed by the apparatus disclosed herein are characterized by very uniform longitudinal distribution of the applied additive. As noted previously, the transverse distribution pattern of the additive is determined by the position of the nozzle means with respect to the advancing tow, the design of the nozzle means and the particular operating conditions used.

Generally, the additive applied to the filter tow in accordance with this invention is confined to a limited zone that coincides largely with the longitudinal axis of the filter rod when the nozzle means is aligned with that axis. It would, of course, be possible to position the nozzle means near the periphery of the bundle of filter tow so that distribution of the additive would occur in a peripheral zone of the formed filter rod. It is also apparent that two or more capillary tubes functioning as nozzle means can be positioned in the path of the advancing filter tow to obtain more complex distribution patterns in the formed filter rod. Separate additive supply systems for each capillary tube would afford a means for depositing two or more flavoring materials at transversely spaced locations in the formed filter rod.

The apparatus disclosed herein would not ordinarily be used as the sole applicator of plasticizer to filter tow because normal operating conditions for this method and apparatus lead to treatment of only about 75 percent of the tow as previously discussed. This apparatus could be used, however, to apply additional quantities of plasticizer to selected portions of the filter rod to modify the firmness characteristics of the formed filter rod.

From the foregoing description, it is evident that this invention provides a convenient means for manufacturing a smoke filter comprising a plasticized, continuous multifilament filter tow formed into an elongated filter rod having individual filaments of the filter tow in substantial alignment with the longitudinal axis of the filter rod and wherein a selected portion of the filter tow is treated with a smoke-modifying agent to give a discrete elongated zone of treated filaments that is in substantial alignment with the longitudinal axis of the filter rod and substantially circumferentially surrounded by plasticized, continuous multifilament filter tow not treated with the smoke-modifying agent, the cross-sectional area of the discrete zone of treated filaments constituting between 1 and 75 percent of the maximum cross-sectional area of the formed filter rod. The formed filter rod is ideally suited to the manufacture of filter cigarettes using known methods for combining axially aligned rods of smokable material and filter rods. The filters may also be used in conjunction with other smoking products such as cigars, cigarillos and pipes.

Although the preferred embodiments shown in the drawings include the application of a paper wrap to the filter tow, the basic arrangement shown could also be used in the manufacture of non-wrapped fibrous filter rods by employing rod-forming means provided with means for heating the filter tow. Apparatus for manufacturing non-wrapped fibrous filter rods is disclosed, for example, in U.S. Pat. No. 3,455,766 and British patent No. 1,519,417 and such apparatus could be employed as the rod-forming means 55 shown in FIGS. 1, 4 and 6. If flavoring materials are applied to filter tow being formed into non-wrapped filter rods, the distribution pattern of the flavoring materials in the formed filter rod may be somewhat more diffuse due to the heat that is applied to the filter tow in connection with the rod-forming operation and some loss of flavoring materials is also likely to occur due to the applied heat This is particularly true when the filter tow is contacted with steam as it moves through the rod-forming means.

EXAMPLE 1

In order to demonstrate the effectiveness of the invention disclosed herein, commercially available filter rod-making apparatus was modified in a manner similar to that shown in FIG. 1. Stainless steel tubing having an inside diameter of approximately 1.6 mm was inserted through a hole in the wall of the converging funnel, the location of the hole being near the entrance end and on the lower side of the funnel. The tubing extended beyond the exit end of the converging funnel and terminated at a point near the entrance end of the tongue device (element 28 in FIG. 1). Solder was applied at the point where the tubing passed through the hole in the converging funnel in order to attach the tubing to the funnel and thereby maintain the termination point of the tubing in a relatively fixed position that was concentrically located and longitudinally aligned with respect to the filter tow entering the tongue section. The termination point of the tubing was sealed off by a plug of solder and a 25-millimeter section of the tubing adjacent to the plugged end was fashioned into nozzle means by providing it with ten 0.4-millimeter diameter holes uniformly spaced longitudinally and circumferentially to produce a radial spray pattern with respect to the longitudinal axis of the tubing. The open end of the stainless steel tubing was connected to one end of an aeration tee located a short distance from the converging funnel. The other end of the tee was connected to a source of compressed air (1550 grams per square centimeter) and the side of the tee was connected to a liquid additive supply source. A solution of flavoring agents in triacetin was delivered to the aeration tee by a stainless steel positive flow gear pump that was mechanically interconnected with the drive motor of a filter rod-making machine by a toothed timing belt. A small quantity of red dye was also incorporated into the triacetin solution so that the distribution pattern and location of the applied additive could be visually observed in the formed filter rod. The filter rod-making machine was operated at a tow speed of 400 meters per minute using cellulose acetate filter tow while the triacetin solution was being injected into the moving tow via the concentrically positioned nozzle means at a rate of 150 milliliters per minute. A visual inspection of the resulting filter rod revealed a very uniform longitudinal as well as radial distribution of the applied additive.

EXAMPLE 2

The procedure of Example 1 was repeated except that the termination point of the stainless steel tubing was not sealed off and not provided with holes in the wall thereof. Thus, the aerated liquid additive was injected in a substantially longitudinal spray pattern rather than a radial spray pattern. The resulting filter rods were very similar to those obtained in Example 1 except that the radial distribution pattern was somewhat more concentrated (i.e., the cross-sectional area of the additive distribution pattern was smaller).

While preferred embodiments of the present invention have been described above, it is apparent that additional modifications are possible without departing from the spirit and scope of the disclosed invention. Such modifications are deemed to fall within the scope of the appended claims.

What is claimed is:

1. A method for manufacturing a filter rod containing a filter tow having portions thereof colored with a dye which comprises (a) moving a continuous multifilament filter tow through a succession of treatment steps, the direction of movement coinciding generally with the longitudinal axis of the filter tow, (b) subjecting the moving filter tow to sufficient tension to produce a longitudinally oriented assemblage of filaments having individual filaments of the tow in substantial alignment, (c) moving the longitudinally oriented assemblage of filaments through converging means designed to gather and compress the assemblage of filaments thereby producing a longitudinally oriented filter tow with a rope-like configuration, (d) injecting a quantity of a dye into the interior portion of the filter tow by nozzle means positioned in the path of the moving filter tow at a selected location that is downstream of a point at which the filter tow has been sufficiently gathered and compressed by the converging means to envelop the nozzle means in substantially encircling fashion, (e) forming the filter tow treated with the dye into a stable, continuous filter rod, and (f) cutting the formed continuous filter rod into suitable lengths for subsequent use in the manufacture of smoking products.

2. The method of claim 1 wherein said dye is contained in a liquid medium that is injected into the interior portion of the filter.

3. The method of claim 2 wherein said liquid medium is injected in the form of a radial spray pattern that is substantially perpendicular to the longitudinal axis of the moving filter tow.

4. The method of claim 2 or 3 wherein said liquid medium is injected in the form of a gas-atomized spray.

5. The method of claim 2 wherein said liquid medium includes a plasticizer.

6. The method of claim 5 wherein the injected dye imparts a red color to portions of the filter tow.

7. The method of claim 1 or 2 wherein said longitudinally oriented, rope-like, treated filter tow is wrapped in a continuous paper web as it is formed into a stable, continuous paper-wrapped filter rod.

8. The method of claim 1 or 2 wherein said longitudinally oriented, rope-like, treated filter tow is heated sufficiently during the rod-forming step to give a stable, continuous non-wrapped filter rod.

9. The method of claim 1 or 2 wherein the advancing filter tow is motivated by a pressurized gaseous medium directed onto the tow as the tow moves through said converging means.

10. The method of claim 1 or 2 wherein said longitudinally oriented assemblage of filaments having individual filaments of the tow in substantial alignment is produced by subjecting the moving filter tow to tension created by contracting the advancing filter tow with one or more circumferentially grooved rolls.

11. The method of claim 1 or 2 wherein said longitudinally oriented assemblage of filaments having individual filaments of the tow in substantial alignment is produced by subjecting the moving filter tow to tension created by advancing the filter tow through a tow-blooming jet device.

12. The method of claim 1 or 2 wherein said dye is continuously injected into the moving filter tow.

13. A smoke filter comprising a plasticized, continuous multifilament filter tow formed into an elongated filter rod having individual filaments of said filter tow in substantial alignment with the longitudinal axis of said filter rod and characterized by the fact that a portion of the filter tow is treated with a dye to impart color to a discrete elongated zone of dye-treated filaments that is in substantial alignment with the longitudinal axis of said filter rod and substantially circumferentially surrounded by plasticized, continuous multifilament filter tow not treated with said dye, the cross-sectional area of said discrete elongated zone of dye-treated filaments constituting between about 1 and 75 percent of the maximum cross-sectional area of said filter rod.

14. The filter of claim 13 wherein the filter tow is circumferentially enveloped by a paper wrap.

15. The filter of claim 13 wherein said discrete elongated zone of dye-treated filaments is spaced radially inwardly from the outer peripheral surface of said filter rod.

16. The filter of claim 13 wherein said discrete elongated zone of dye-treated filaments is substantially coaxial with the longitudinal axis of the filter rod.

17. The filter of claim 13 wherein said continuous multifilament filter tow comprises cellulose acetate.

18. The filter of claim 13, 14, 15, 16 or 17 wherein the cross-sectional area of said discrete elongated zone of dye-treated filaments constitutes between 3 and 50 percent of the maximum cross-sectional area of said filter rod.

19. A filter cigarette comprising a rod of smokable material having a smoke filter axially aligned with and affixed to one end of said rod of smokable material, said smoke filter comprising a plasticized, continuous multifilament filter tow formed into an elongated filter rod having individual filaments of said filter tow in substantial alignment with the longitudinal axis of said filter rod, said filter cigarette being characterized by the fact that a portion of the filter tow of said smoke filter is treated with a dye to impart color to a discrete elongated zone of dye-treated filaments that is in substantial alignment with the longitudinal axis of said filter rod and substantially circumferentially surrounded by plasticized, continuous multifilament filter tow not treated with said dye, the cross-sectional area of said discrete elongated zone of dye-treated filaments constituting between 1 and 75 percent of the maximum cross-sectional area of said filter rod.

20. The filter cigarette of claim 19 wherein said discrete elongated zone of dye-treated filaments in said filter rod is spaced radially inwardly from the outer peripheral surface of said filter rod.

21. The filter cigarette of claim 19 wherein said discrete elongated zone of dye-treated filaments in said filter rod is substantially coaxial with the longitudinal axis of said filter rod.

22. The filter cigarette of claim 19 wherein said continuous multifilament filter tow in said smoke filter comprises cellulose acetate.

23. The filter cigarette of claim 19, 20, 21 or 22 wherein said cross-sectional area of said discrete elongated zone of dye-treated filaments in said filter rod constitutes between 3 and 50 percent of the maximum cross-sectional area of said filter rod.

* * * * *

UNITED STATES PATENT AND TRADEMARK OFFICE

CERTIFICATE OF CORRECTION

PATENT NO. : 4,770,193

DATED : September 13, 1988

INVENTOR(S) : James W. Pryor

It is certified that error appears in the above—identified patent and that said Letters Patent is hereby corrected as shown below:

Column 8, line 44, insert space after "plasticizer".

Column 12, line 59, change "contracting" to --contacting--.

Signed and Sealed this

Seventh Day of February, 1989

*Attest:*

DONALD J. QUIGG

*Attesting Officer*

*Commissioner of Patents and Trademarks*